US008242860B2

(12) United States Patent
Lin et al.

(10) Patent No.: US 8,242,860 B2
(45) Date of Patent: Aug. 14, 2012

(54) SEQUENTIAL ROTATED FEEDING CIRCUIT

(75) Inventors: Shih-Kai Lin, Taipei (TW); Yi-Cheng Lin, Taipei (TW)

(73) Assignee: National Taiwan University, Taipei (TW)

( * ) Notice: Subject to any disclaimer, the term of this patent is extended or adjusted under 35 U.S.C. 154(b) by 499 days.

(21) Appl. No.: 12/574,639

(22) Filed: Oct. 6, 2009

(65) Prior Publication Data

US 2011/0001577 A1 Jan. 6, 2011

(30) Foreign Application Priority Data

Jul. 2, 2009 (TW) ..... 98122372 A

(51) Int. Cl.
*H01P 5/12* (2006.01)

(52) U.S. Cl. ..... 333/125; 333/127; 333/128; 333/33

(58) Field of Classification Search ..... 333/125–129, 333/32, 334; 343/700 MS, 829
See application file for complete search history.

(56) References Cited

U.S. PATENT DOCUMENTS 5,382,959 A * 1/1995 Pett et al. ..... 343/700 MS
5,661,494 A * 8/1997 Bondyopadhyay .... 343/700 MS
6,288,677 B1 * 9/2001 Fink ..... 343/700 MS
7,646,263 B1 * 1/2010 Ergene et al. ..... 333/137

* cited by examiner

*Primary Examiner* — Robert Pascal
*Assistant Examiner* — Kimberly Glenn

(57) ABSTRACT

A sequential rotated feeding circuit for sequential rotated feeding of a signal with a wavelength $\lambda_g$ is provided. The sequential rotated feeding circuit comprises a feed transformer, a resistance transforming unit, a first antenna transformer, a second antenna transformer, a third antenna transformer and a fourth antenna transformer. The feed transformer has a feed line width resistance $Z_{in}$. The resistance transforming unit is connected to the feed transformer, the first antenna transformer, the second antenna transformer, the third antenna transformer and the fourth antenna transformer. The resistance transforming unit has a transforming line width resistance $Z_l$. The first antenna transformer, the second antenna transformer, the third antenna transformer and the fourth antenna transformer have an antenna line width resistance $Z_a$, and the feed line width resistance $Z_{in}$, the transforming line width resistance $Z_l$, and the antenna line width resistance $Z_a$ satisfy the following formula:

$$Z_l=\sqrt{Z_a Z_{in}}.$$

12 Claims, 5 Drawing Sheets

SEQUENTIAL ROTATED FEEDING CIRCUIT

CROSS REFERENCE TO RELATED APPLICATIONS

This Application claims priority of Taiwan Patent Application No. 098122372, filed on Jul. 2, 2009, the entirety of which is incorporated by reference herein.

BACKGROUND OF THE INVENTION

1. Field of the Invention

The present invention relates to a sequential rotated feeding circuit, and in particular relates to a sequential rotated feeding circuit with decreased dimensions.

2. Description of the Related Art

Sequential rotated feeding circuits are utilized for feeding signals to an antenna array. There are three types of conventional sequential rotated feeding circuits: (a) Parallel type, (b) Series type, and (c) Hybrid ring with parallel type. A conventional sequential rotated feeding circuit is relatively large. For example, a parallel type sequential rotated feeding circuit has a circuit area about $$\frac{3\lambda}{4}\times\frac{3\lambda}{4},$$

wherein λ is a wavelength of a wireless signal transmitted by the antenna array. A series type sequential rotated feeding circuit has a circuit area about $$\frac{\lambda}{4}\times\frac{3\lambda}{4}.$$

A hybrid ring with parallel type sequential rotated feeding circuit has a circuit area about.

$$\lambda\times\frac{3\lambda}{4}.$$

The large dimensions of the conventional sequential rotated feeding circuit causes increased distances between antenna units of the antenna array, which generates a side lobe, and deteriorates signal transmission effect.

Additionally, for conventional sequential rotated feeding circuit, different line width designs are utilized (more than four line width designs) to satisfy resistance matching requirements. Thus, the design of conventional sequential rotated feeding circuit is complex, with large circuit area.

BRIEF SUMMARY OF THE INVENTION

A detailed description is given in the following embodiments with reference to the accompanying drawings.

A sequential rotated feeding circuit for sequential rotated feeding of a signal with a wavelength $\lambda_g$ is provided. The sequential rotated feeding circuit comprises a feed transformer, a resistance transforming unit, a first antenna transformer, a second antenna transformer, a third antenna transformer and a fourth antenna transformer. The feed transformer has a feed line width resistance $Z_{in}$. The resistance transforming unit is connected to the feed transformer, the first antenna transformer, the second antenna transformer, the third antenna transformer and the fourth antenna transformer. The resistance transforming unit has a transforming line width resistance $Z_l$. The first antenna transformer, the second antenna transformer, the third antenna transformer and the fourth antenna transformer have an antenna line width resistance $Z_a$, and the feed line width resistance $Z_{in}$, the transforming line width resistance $Z_l$, and the antenna line width resistance $Z_a$ satisfy the following formula:

$$Z_l=\sqrt{Z_a Z_{in}}.$$

The embodiment of the invention simplifies the line width design thereof, and allows more design freedom. A circuit area of the sequential rotated feeding circuit may be reduced, and the shape of the sequential rotated feeding circuit may be a square. Compared with conventional art, the embodiment of the invention has decreased dimensions, a reduced side lobe and improved signal transmission effect.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
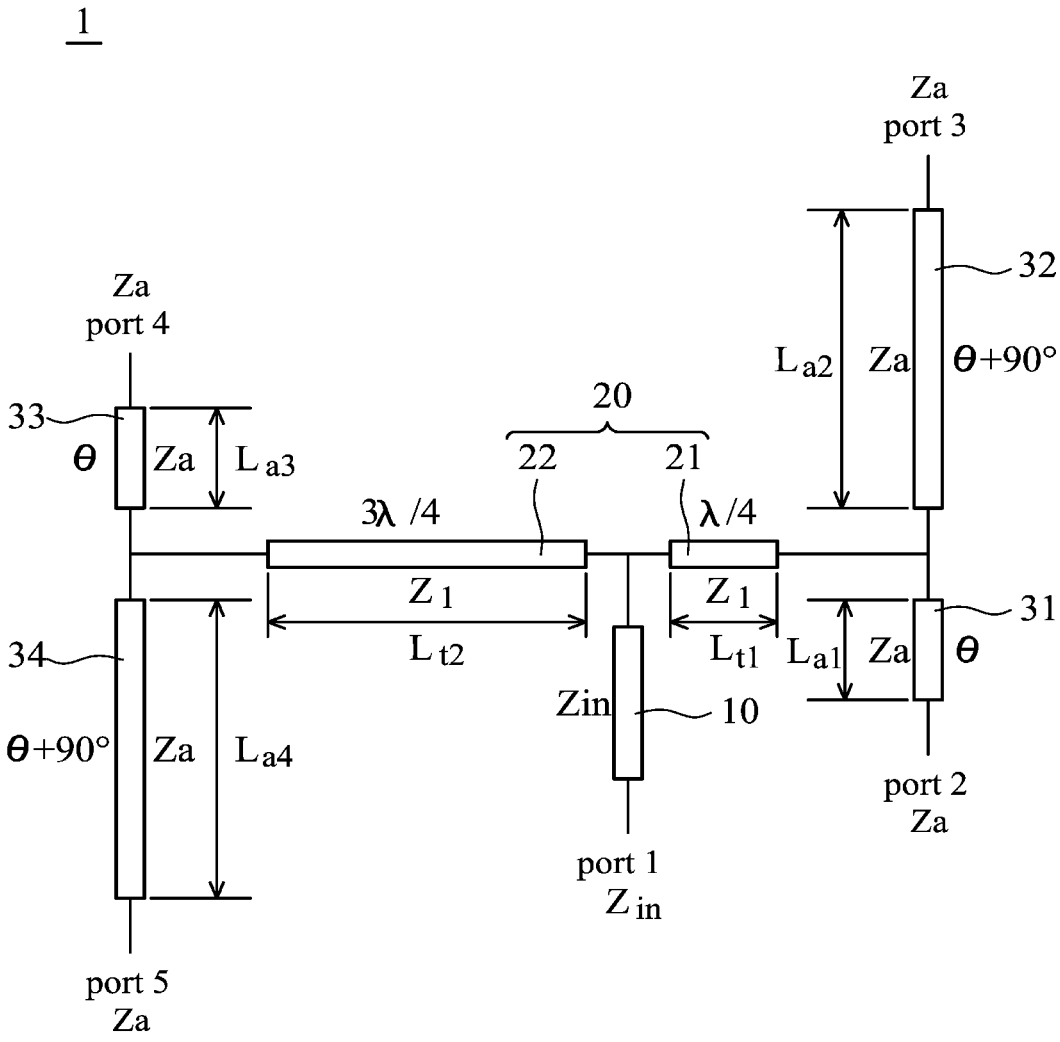
FIG. 1 shows an equivalent circuit of the sequential rotated feeding circuit of an embodiment of the invention.

FIG. 1 shows an equivalent circuit of the sequential rotated feeding circuit 1 of an embodiment of the invention for sequential rotated feeding of a signal with a wavelength $\lambda_g$. The sequential rotated feeding circuit 1 comprises a feed transformer 10, a resistance transforming unit 20, a first antenna transformer 31, a second antenna transformer 32, a third antenna transformer 33 and a fourth antenna transformer 34. The feed transformer 10 has a feed line width resistance $Z_{in}$. The resistance transforming unit 20 comprises a first resistance transformer 21 and a second resistance transformer 22. The first resistance transformer 21 and the second resistance transformer 22 are connected to the feed transformer 10. The first resistance transformer 21 and the second resistance transformer 22 have a transforming line width resistance $Z_l$. The first antenna transformer 31 is connected to the first resistance transformer 21. The second antenna transformer 32 is connected to the first resistance transformer 21. The third antenna transformer 33 is connected to the second resistance transformer 22. The fourth antenna transformer 34 is connected to the second resistance transformer 22. The first antenna transformer 31, the second antenna transformer 32, the third antenna transformer 33 and the fourth antenna transformer 34 have an antenna line width resistance $Z_a$. The feed line width resistance $Z_{in}$, the transforming line width resistance $Z_l$, and the antenna line width resistance $Z_a$ satisfy the following formula:

$$Z_l=\sqrt{Z_a Z_{in}} \quad \text{(Formula 1)}$$

The first resistance transformer 21 comprises a first resistance transforming length $L_{t1}$, the second resistance transformer 22 comprises a second resistance transforming length $L_{t2}$, the first resistance transforming length $L_{t1}$ is $$\frac{\lambda_g}{4},$$

and the second resistance transforming length $L_{t2}$ is $$\frac{3\lambda_g}{4}.$$

In one embodiment, a line width of the feed transformer 10, a line width of the resistance transforming unit 20, a line width of the first antenna transformer 31, a line width of the second antenna transformer 32, a line width of the third antenna transformer 33 and a line width of the fourth antenna transformer 34 are the same.

In the embodiments of the invention, the feed line width resistance $Z_{in}$, the transforming line width resistance $Z_l$, and the antenna line width resistance $Z_a$ are designed according to Formula 1. If an antenna line width resistance $Z_a$ is equal to the feed line width resistance $Z_{in}$, only one line width is required in the sequential rotated feeding circuit design. If the antenna line width resistance $Z_a$ is not equal to the feed line width resistance $Z_{in}$, only three line widths are required in the sequential rotated feeding circuit design. The embodiment simplifies the sequential rotated feeding circuit design.

The first antenna transformer has a length $L_{a1}$, the second antenna transformer has a length $L_{a2}$, the third antenna transformer has a length $L_{a3}$, the fourth antenna transformer has a length $L_{a4}$, the length $L_{a1}$ of first antenna transformer is equal to the length $L_{a3}$ of third antenna transformer, and the length $L_{a2}$ of second antenna transformer is equal to the length $L_{a4}$ of fourth antenna transformer. The length $L_{a2}$ of second antenna transformer is $$\frac{\lambda_g}{4}$$

longer than the length $L_{a1}$ of first antenna transformer. That is, the phase angles of the second antenna transformer and the first antenna transformer have a difference of 90°.

When designing the sequential rotated feeding circuit of the embodiment of the invention, an initial phase angle θ can be firstly determined, wherein the length $L_{a1}$ of first antenna transformer and the length $L_{a3}$ of third antenna transformer are $$\frac{\theta\times\lambda_g}{360},$$

and the length $L_{a2}$ of second antenna transformer and the length $L_{a4}$ of fourth antenna transformer are $$\frac{(\theta+90)\times\lambda_g}{360}.$$

The embodiment of the invention simplifies the design of line width, and allows more design freedom. A circuit area of the sequential rotated feeding circuit may be reduced, and the shape of the sequential rotated feeding circuit may be a square.

Figure 2A:
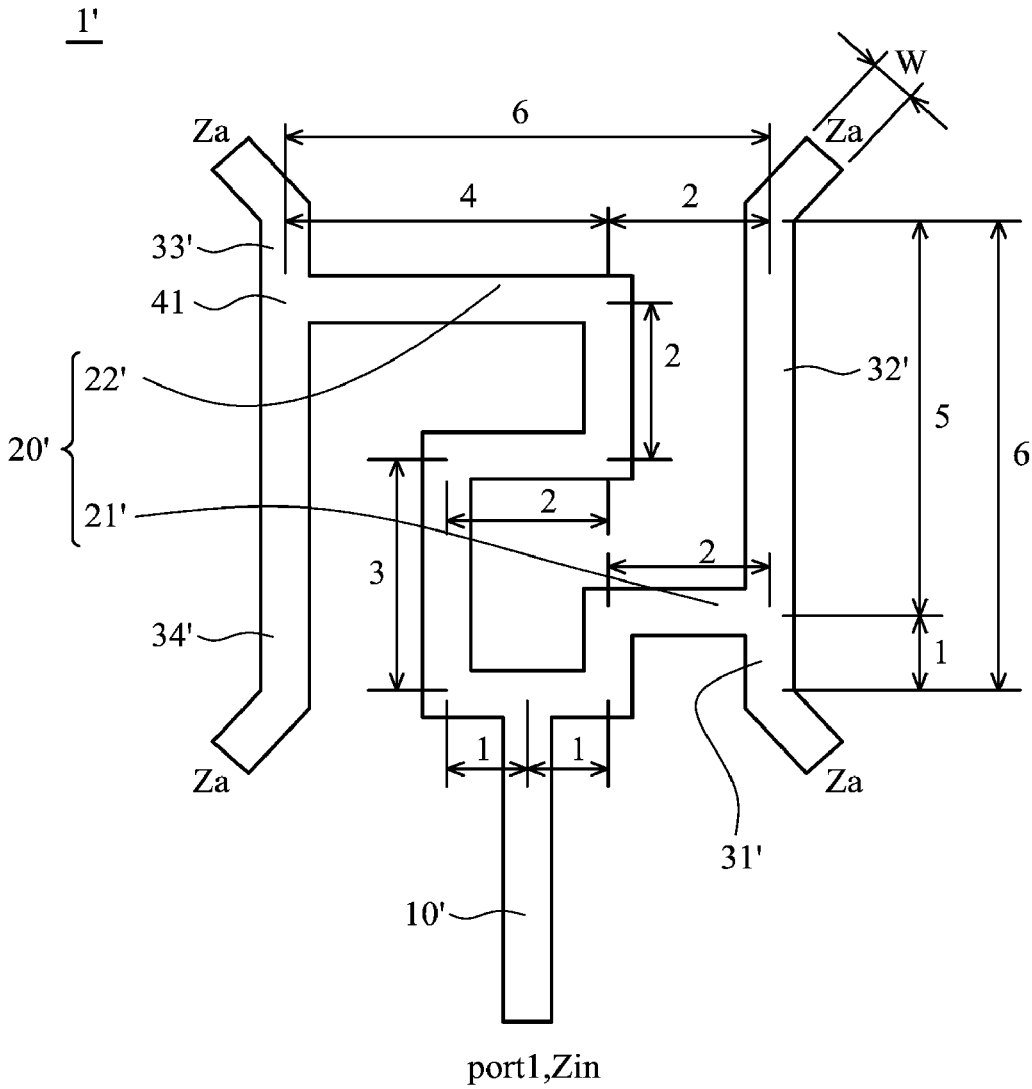
FIG. 2*a* shows a sequential rotated feeding circuit of a first embodiment of the invention.

FIG. 2*a* shows a sequential rotated feeding circuit 1' of a first embodiment of the invention. The sequential rotated feeding circuit 1' comprises a feed transformer 10', a resistance transforming unit 20', a first antenna transformer 31', a second antenna transformer 32', a third antenna transformer 33' and a fourth antenna transformer 34'. The resistance transforming unit 20' comprises a first resistance transformer 21' and a second resistance transformer 22'. The first resistance transformer 21' and the second resistance transformer 22' are connected to the feed transformer 10'. The first antenna transformer 31' is connected to the first resistance transformer 21'. The second antenna transformer 32' is connected to the first resistance transformer 21'. The third antenna transformer 33' is connected to the second resistance transformer 22'. The fourth antenna transformer 34' is connected to the second resistance transformer 22'.

The first resistance transformer comprises a first resistance transforming length $L_{t1}'$, the second resistance transformer comprises a second resistance transforming length $L_{t2}'$, the first resistance transforming length $L_{t1}'$ is $$\frac{\lambda_g}{4},$$

and the second resistance transforming length $L_{t2}'$ is $$\frac{3\lambda_g}{4}.$$

The first antenna transformer has a length $L_{a1}'$, the second antenna transformer has a length $L_{a2}'$, the third antenna transformer has a length $L_{a3}'$, the fourth antenna transformer has a length $L_{a4}'$, the length $L_{a1}'$ of first antenna transformer is equal to the length $L_{a3}'$ of third antenna transformer, the length $L_{a2}'$ of second antenna transformer is equal to the length $L_{a4}'$ of fourth antenna transformer, and the length $L_{a2}'$ of second antenna transformer is $$\frac{\lambda_g}{4}$$

longer than the length $L_{a1}'$ of first antenna transformer. That is, the phase angles of the second antenna transformer and the first antenna transformer have a difference of 90°.

In the first embodiment, the initial phase angle θ is 22.5°, wherein the length $L_{a1}'$ of first antenna transformer and the length $L_{a3}'$ of third antenna transformer are $$\frac{\theta\times\lambda_g}{360},$$

and the length $L_{a2}'$ of second antenna transformer and the length $L_{a4}'$ of fourth antenna transformer are $$\frac{(\theta+90)\times\lambda_g}{360}.$$

Figure 2B:
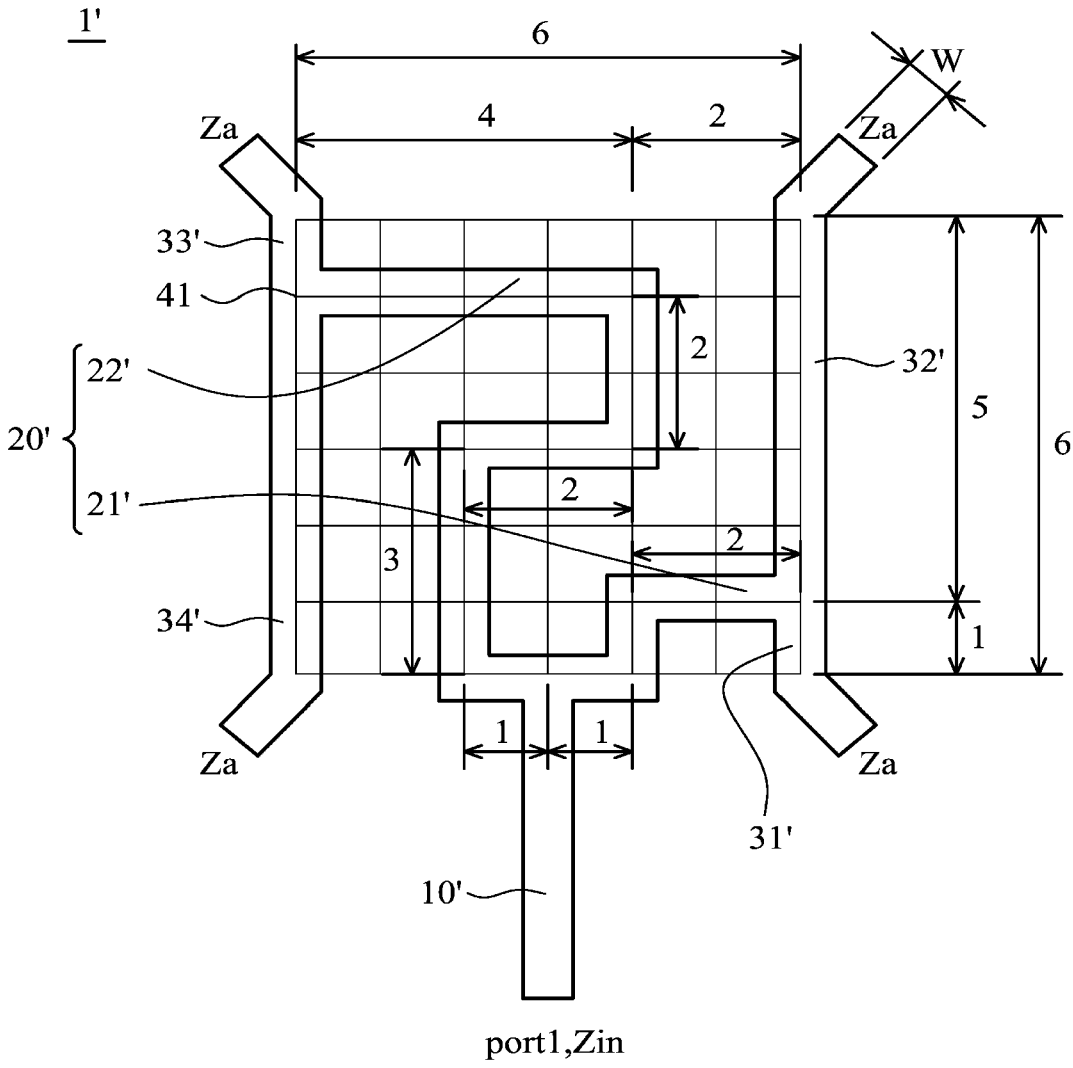
FIG. 2*b* shows the sequential rotated feeding circuit of the first embodiment on a 6*6 square matrix.

In FIGS. 2*a* and 2*b*, a unit length (side length of unit square) is $$\frac{\lambda_g}{16}.$$

With reference to FIG. 2*b*, when designing the sequential rotated feeding circuit 1' of the first embodiment, a 6*6 square matrix 41 may be utilized. The feed transformer 10', the resistance transforming unit 20', the first antenna transformer 31', the second antenna transformer 32', the third antenna transformer 33' and the fourth antenna transformer 34' extend along the sides of the unit squares of the 6*6 square matrix 41. Therefore, the sequential rotated feeding circuit 1' can be shaped into a square. The circuit area of the sequential rotated feeding circuit of the first embodiment is about $$\frac{3\lambda_g}{8}\times\frac{3\lambda_g}{8},$$

which has decreased dimensions, reduced side lobe and improving signal transmission effect.

Figure 3A:
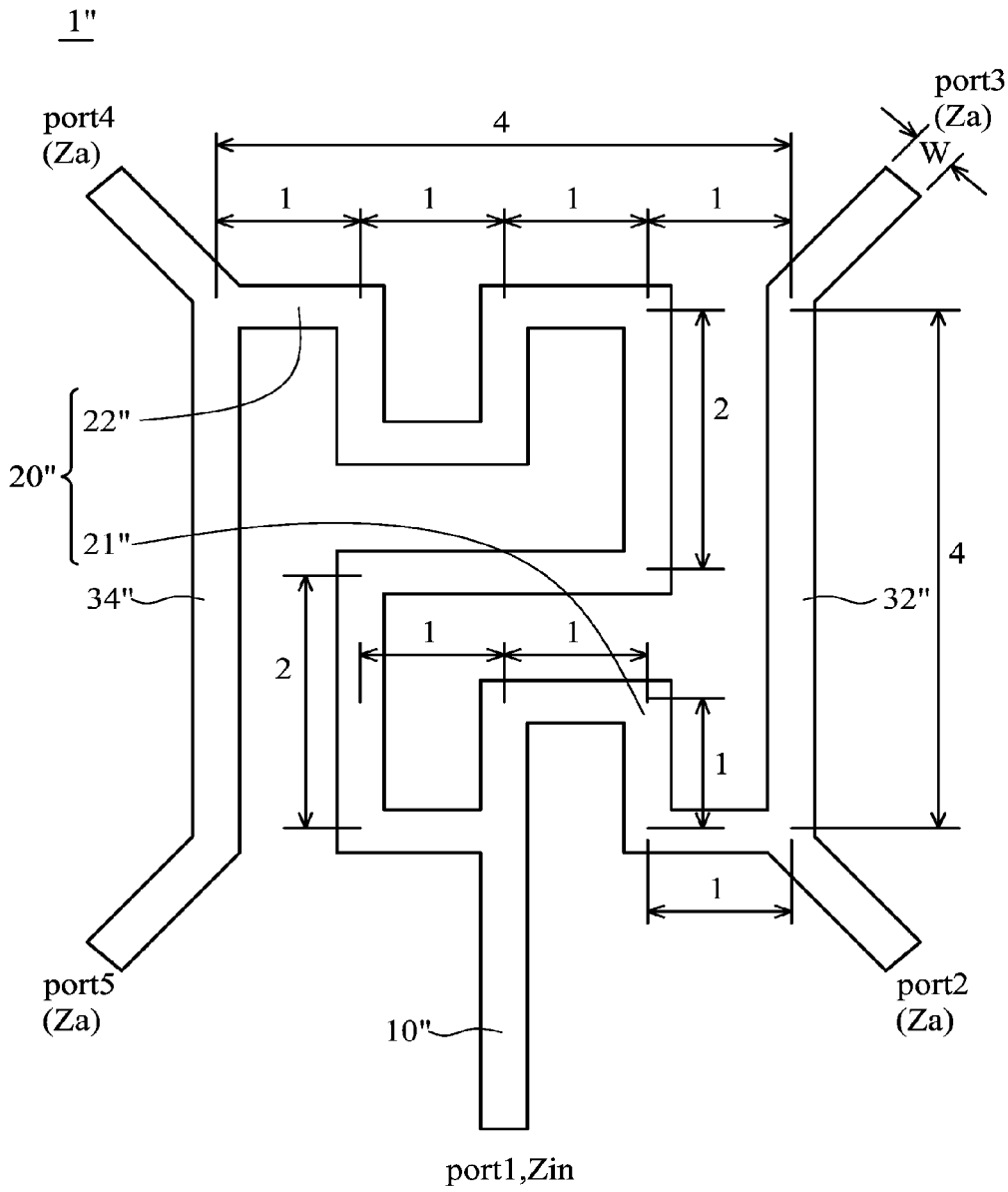
FIG. 3*a* shows a sequential rotated feeding circuit of a second embodiment of the invention.

FIG. 3*a* shows a sequential rotated feeding circuit 1" of a second embodiment of the invention. The sequential rotated feeding circuit 1" comprises a feed transformer 10", a resistance transforming unit 20", a second antenna transformer 32", and a fourth antenna transformer 34". The resistance transforming unit 20" comprises a first resistance transformer 21" and a second resistance transformer 22". The first resistance transformer 21" and the second resistance transformer 22" are connected to the feed transformer 10". The second antenna transformer 32" is connected to the first resistance transformer 21". The fourth antenna transformer 34" is connected to the second resistance transformer 22".

The first resistance transformer comprises a first resistance transforming length $L_{t1}''$ the second resistance transformer comprises a second resistance transforming length $L_{t2}''$, the first resistance transforming length $L_{t1}''$ is $$\frac{\lambda_g}{4},$$

and the second resistance transforming length $L_{t2}''$ is $$\frac{3\lambda_g}{4}.$$

The second antenna transformer has a length $L_{a2}''$, the fourth antenna transformer has a length $L_{a4}''$, and the length $L_{a2}''$ of second antenna transformer is equal to the length $L_{a4}''$ of fourth antenna transformer.

In the second embodiment, the initial phase angle θ is 0°, wherein the length $L_{a1}'$ of the first antenna transformer and the length $L_{a3}'$ of the third antenna transformer are 0. That is, the first antenna transformer and the third antenna transformer are omitted. The length $L_{a2}''$ of second antenna transformer and the length $L_{a4}''$ of fourth antenna transformer are $$\frac{(\theta+90)\times\lambda_g}{360}.$$

Figure 3B:
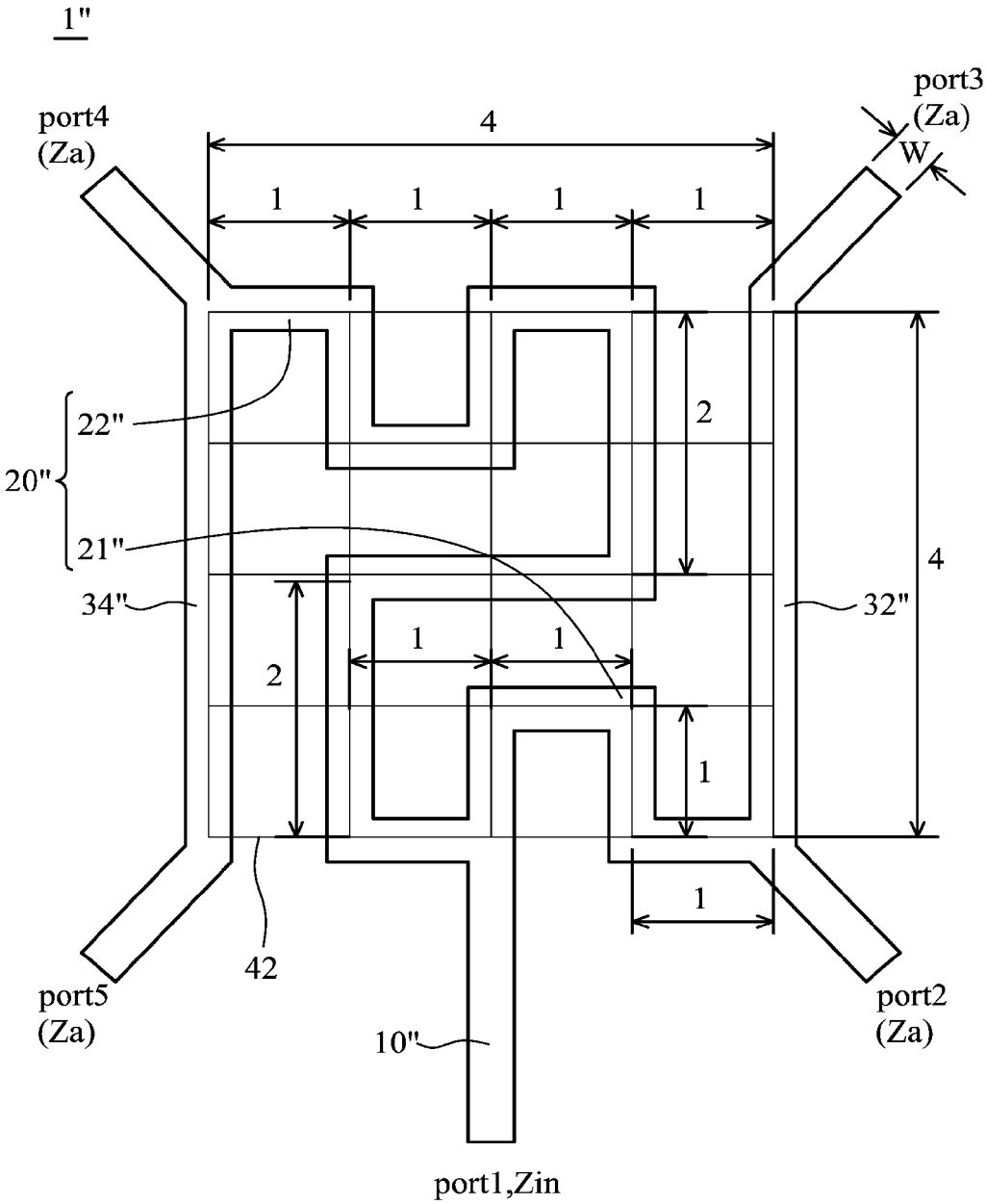
FIG. 3*b* shows the sequential rotated feeding circuit of the second embodiment on a 4*4 square matrix.

In FIGS. 3*a* and 3*b*, a unit length (side length of unit square) is $$\frac{\lambda_g}{16}.$$

With reference to FIG. 3*b*, when designing the sequential rotated feeding circuit 1" of the second embodiment, a 4*4 square matrix 42 may be utilized. The feed transformer 10", the resistance transforming unit 20", the second antenna transformer 32" and the fourth antenna transformer 34" extend along the sides of the unit squares of the 4*4 square matrix 42. The circuit area of the sequential rotated feeding circuit of the second embodiment is about $$\frac{\lambda_g}{4}\times\frac{\lambda_g}{4},$$

which has decreased dimensions, reduced side lobe and improved signal transmission effect when compared to conventional art.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sequential rotated feeding circuit for sequential rotated feeding of a signal with a wavelength $\lambda_g$, comprising:

a feed transformer, having a feed line width resistance $Z_{in}$;

a resistance transforming unit, comprising a first resistance transformer and a second resistance transformer, wherein the first resistance transformer and the second resistance transformer are connected to the feed transformer, and the first resistance transformer and the second resistance transformer have a transforming line width resistance $Z_l$;

a first antenna transformer, connected to the first resistance transformer;

a second antenna transformer, connected to the first resistance transformer;

a third antenna transformer, connected to the second resistance transformer; and a fourth antenna transformer, connected to the second resistance transformer, wherein the first antenna transformer, the second antenna transformer, the third antenna transformer and the fourth antenna transformer have an antenna line width resistance $Z_a$, and the feed line width resistance $Z_{in}$, the transforming line width resistance $Z_l$, and the antenna line width resistance $Z_a$ satisfy the following formula:

$$Z_l=\sqrt{Z_a Z_{in}}.$$

2. The sequential rotated feeding circuit as claimed in claim 1, wherein the first resistance transformer comprises a first resistance transforming length $L_{t1}$, the second resistance transformer comprises a second resistance transforming length $L_{t2}$, the first resistance transforming length $L_{tl}$ is $$\frac{\lambda_g}{4},$$

and the second resistance transforming length $L_{t2}$ is $$\frac{3\lambda_g}{4}.$$

3. The sequential rotated feeding circuit as claimed in claim 2, wherein the first antenna transformer has a length $L_{a1}$, the second antenna transformer has a length $L_{a2}$, the third antenna transformer has a length $L_{a3}$, the fourth antenna transformer has a length $L_{a4}$, the length $L_{a1}$ of first antenna transformer is equal to the length $L_{a3}$ of third antenna transformer, the length $L_{a2}$ of second antenna transformer is equal to the length $L_{a4}$ of fourth antenna transformer, and the length $L_{a2}$ of second antenna transformer is $$\frac{\lambda_g}{4}$$

longer than the length $L_{a1}$ of first antenna transformer.

4. The sequential rotated feeding circuit as claimed in claim 1, wherein a line width of the feed transformer, a line width of the resistance transforming unit, a line width of the first antenna transformer, a line width of the second antenna transformer, a line width of the third antenna transformer and a line width of the fourth antenna transformer are the same.

5. A design method for a sequential rotated feeding circuit, comprising:

providing the sequential rotated feeding circuit as claimed in claim 3; and determining an initial phase angle θ, wherein the length $L_{a1}$ of first antenna transformer is $$\frac{\theta + \lambda_g}{360}.$$

6. The design method as claimed in claim 5, wherein the initial phase angle θ is 0°.

7. The design method as claimed in claim 6, further comprising:

providing a 4*4 square matrix, wherein the feed transformer, the resistance transforming unit, the first antenna transformer, the second antenna transformer, the third antenna transformer and the fourth antenna transformer extend along sides of unit squares of the 4*4 square matrix.

8. The design method as claimed in claim 7, wherein a length of the side of the unit square is $$\frac{\lambda_g}{16}.$$

9. The design method as claimed in claim 5, wherein the initial phase angle θ is 22.5°.

10. The design method as claimed in claim 9, further comprising:

providing a 6*6 square matrix, wherein the feed transformer, the resistance transforming unit, the first antenna transformer, the second antenna transformer, the third antenna transformer and the fourth antenna transformer extend along sides of unit squares of the 6*6 square matrix.

11. The design method as claimed in claim 10, wherein a length of the side of the unit square is $$\frac{\lambda_g}{16}.$$

12. A sequential rotated feeding circuit for sequential rotated feeding of a signal with a wavelength $\lambda_g$, comprising:

a feed transformer, having a feed line width resistance $Z_{in}$;

a resistance transforming unit, comprising a first resistance transformer and a second resistance transformer, wherein the first resistance transformer and the second resistance transformer are connected to the feed transformer, and the first resistance transformer and the second resistance transformer have a transforming line width resistance $Z_l$;

a first antenna transformer, connected to the first resistance transformer, wherein a length of the first antenna transformer is $$\frac{\lambda_g}{4};$$

a second antenna transformer, connected to the second resistance transformer, wherein a length of the second antenna transformer is $$\frac{\lambda_g}{4},$$

and the first antenna transformer and the second antenna transformer have an antenna line width resistance $Z_a$, and the feed line width resistance $Z_{in}$, the transforming line width resistance $Z_l$, and the antenna line width resistance $Z_a$ satisfy the following formula:

$$Z_l = \sqrt{Z_a Z_{in}}.$$

* * * * *